US006561676B1

(12) United States Patent
Fischer et al.

(10) Patent No.: US 6,561,676 B1
(45) Date of Patent: May 13, 2003

(54) LUMINAIRE ASSEMBLY

(75) Inventors: Jerry F. Fischer, West Chester, OH (US); John Boyer, Lebanon, OH (US)

(73) Assignee: LSI Industries Inc., Cincinnati, OH (US)

( * ) Notice: Subject to any disclaimer, the term of this patent is extended or adjusted under 35 U.S.C. 154(b) by 49 days.

(21) Appl. No.: 09/713,944

(22) Filed: Nov. 16, 2000

Related U.S. Application Data

(63) Continuation of application No. 09/327,775, filed on Jun. 7, 1999, now Pat. No. 6,283,618.

(51) Int. Cl.[7] ..... F21S 8/04

(52) U.S. Cl. ..... 362/263; 362/263; 362/265; 362/368; 362/404

(58) Field of Search ..... 362/263, 264, 362/265, 362, 368, 370, 371, 296; 174/50

(56) References Cited

U.S. PATENT DOCUMENTS

| | | | | |
|---|---|---|---|---|
| 1,873,310 | A | | 8/1932 | Doane |
| 2,971,670 | A | | 2/1961 | McCormack |
| 3,019,333 | A | | 1/1962 | Pascucci |
| 3,142,447 | A | | 7/1964 | Bodian |
| 3,158,329 | A | | 11/1964 | Wince |
| 3,281,588 | A | | 10/1966 | Spinetta |
| 3,302,019 | A | | 1/1967 | Menzin |
| D207,414 | S | | 4/1967 | Lum et al. |
| 3,328,579 | A | | 6/1967 | Green |
| 3,404,269 | A | | 10/1968 | Schiffer et al. |
| 3,432,629 | A | | 3/1969 | Field et al. |
| 3,473,015 | A | | 10/1969 | Haas et al. |
| 3,511,984 | A | | 5/1970 | Blaisdell et al. |
| 3,644,729 | A | | 2/1972 | McFarlin |
| 3,662,165 | A | | 5/1972 | Osteen et al. |
| 3,755,665 | A | | 8/1973 | Grindle |
| 3,919,459 | A | | 11/1975 | Van Steenhoven |
| 3,983,387 | A | | 9/1976 | Van Steenhoven et al. |
| 3,986,019 | A | | 10/1976 | deVos et al. |
| 4,028,542 | A | | 6/1977 | McReynolds, Jr. |
| 4,222,093 | A | | 9/1980 | Garcia et al. |
| 4,255,781 | A | | 3/1981 | Plemmons et al. |
| 4,286,313 | A | | 8/1981 | Quiogue |
| 4,356,537 | A | | 10/1982 | Stahlhut et al. |
| 4,363,086 | A | * | 12/1982 | Fletcher ..... 362/368 |
| 4,384,319 | A | | 5/1983 | Blaisdell et al. |
| D269,639 | S | | 7/1983 | Eargle, Jr. et al. |
| 4,400,766 | A | | 8/1983 | Munson |
| 4,403,277 | A | * | 9/1983 | Eargle, Jr. et al. ..... 362/263 |
| 4,403,278 | A | | 9/1983 | Flood |
| 4,460,947 | A | | 7/1984 | Kelly |
| 4,460,948 | A | | 7/1984 | Malola |

(List continued on next page.)

*Primary Examiner*—Thomas M. Sember
(74) *Attorney, Agent, or Firm*—Wood, Herron & Evans, LLP

(57) ABSTRACT

A luminaire assembly includes a ballast housing, a wiring box mounted on an upper end of the ballast housing, and an optical assembly mounted on a lower end of the ballast housing. The ballast housing preferably includes a pair of identically configured ballast housing members that are integrally formed from sheet metal and folded by hand prior to final assembly of the ballast housing. The wiring box includes bent tabs that pivotally support the ballast housing between operative and inoperative positions to simplify installation of the luminaire assembly at a site. A hook and rotatable connector are provided to support the wiring box from a luminaire support member. An optional spacer box is provided to space the ballast housing from the wiring box as may be required in certain high wattage applications. The optical assembly is supported below the ballast housing by a pair of support arms that depend from the ballast housing and releasably engage with the optical assembly. An optional lens is mounted to a lower end of the optical assembly that automatically pivots relative to the optical assembly upon a manual pulling force applied to the lens. Methods of making a luminaire assembly are also disclosed.

33 Claims, 8 Drawing Sheets

U.S. PATENT DOCUMENTS 4,494,175 A 1/1985 Gawad et al.
4,654,768 A 3/1987 Dryman et al.
4,661,892 A 4/1987 Reed, Jr.
4,816,977 A 3/1989 Sorensen
4,943,901 A 7/1990 Baldwin et al.
5,014,170 A 5/1991 Gawad et al.
5,034,859 A 7/1991 Gawad et al.
5,121,309 A 6/1992 Ewing et al.
5,134,554 A 7/1992 Donato et al.
5,136,490 A * 8/1992 Morrison ..... 362/294
5,351,174 A * 9/1994 Ewing ..... 362/226
5,398,178 A 3/1995 Roth
5,420,769 A 5/1995 Ahlgren et al.
5,434,765 A 7/1995 Kelly et al.
D368,974 S 4/1996 Belisle
5,508,902 A 4/1996 Shoemaker
5,588,737 A 12/1996 Kusmer
5,662,407 A 9/1997 Fischer et al.
5,664,869 A 9/1997 Bitton

* cited by examiner

LUMINAIRE ASSEMBLY

The present application is a continuation of U.S. Ser. No. 09/327,775, filed Jun. 7, 1999, now U.S. Pat. No. 6,283,618 the disclosure of which is hereby incorporated herein by reference in its entirety.

FIELD OF THE INVENTION

The present invention relates generally to luminaires and, more particularly, to a luminaire assembly for use in indoor industrial, retail and similar lighting environments.

BACKGROUND OF THE INVENTION

Luminaires are designed to produce a predetermined light distribution pattern in an area to be illuminated, such as areas found in indoor industrial, retail and similar lighting environments. Typically, luminaires include a ballast housing for supporting electrical hardware associated with the luminaire, and an optical assembly mounted to a lower end of the ballast housing. The optical assembly may include a lamp socket, a light source mounted in the lamp socket, and a reflector or refractor for providing the desired distribution of light from the light source. A lens may be mounted to a lower end of the optical assembly to enclose the light source within the reflector or refractor.

Typically, luminaires are mounted high above the surface to be illuminated by mounting the luminaire directly to the ceiling or ceiling supports, by suspending the luminaire from a large hook or threaded male pendant support that extends downwardly from the ceiling, or by mounting the luminaire directly to an electrical outlet box. Manufacturers of luminaires must therefore provide for these different approaches to mounting of the luminaire by either specific adaptation of the luminaire at the installation site or, alternatively, by providing mounting adaptors that accommodate the various kinds of installation requirements that may be encountered by the luminaire. During the installation process, electrical connections must be established between the electrical hardware of the luminaire and building power through the use of either a standard electrical cord and plug or by through-wiring in the electrical outlet box associated with the luminaire.

In the past, manufacturers of luminaires have typically shipped at least partially assembled luminaires to the installation site with the expectation that the luminaire will be supported by one or more installers during the installation process as the necessary mechanical and electrical connections are made. Thus, when a threaded pendent support is used, or the luminaire is mounted directly to an electrical outlet box, the luminaire must be manually held in place while the luminaire is mounted to the appropriate support and the required wiring connections are made. The installer must therefore concentrate on supporting the heavy luminaire at the mechanical and electrical connection site while at the same time being able to access the various tools required for installation of the luminaire. These tasks significantly add to the complexity of the installation process and greatly reduce the efficiency of the installer.

Thus, there is a need for a luminaire assembly that may be relatively easily installed at a mechanical and electrical connection site by a single installer. There is also a need for a luminaire assembly that is readily adaptable to a variety of mounting alternatives without requiring a variety of tools to complete the installation process. There is yet also a need for a luminaire assembly that does not require the full weight of the luminaire to be supported by the installer during the installation process.

SUMMARY OF THE INVENTION

The present invention overcomes the foregoing and other shortcomings and drawbacks of luminaires and methods of installing luminaires heretofore known. While the invention will be described in connection with certain embodiments, it will be understood that the invention is not limited to these embodiments. On the contrary, the invention includes all alternatives, modifications and equivalents as may be included within the spirit and scope of the present invention.

In accordance with the principles of the present invention, a modular luminaire assembly is provided that includes an elongated ballast housing, a wiring box mounted to an upper end of the ballast housing, and an optical assembly mounted to a lower end of the ballast housing. The ballast housing is adapted to enclose electrical hardware associated with the luminaire assembly and includes a pair of integral ballast housing members that are each preferably fabricated from a single metal sheet. Each of the ballast housing members is preferably identical in construction and includes either a top panel or a bottom panel, and a side panel integrally joined to the top or bottom panels. The side panels are joined to the top and bottom panels through fold lines that permit the side panels to be folded by hand generally perpendicularly to the top and bottom panels. Before the folding operation, the ballast housing members have a configuration that is easily stackable or nestable.

To assemble the ballast housing, the pair of ballast housing members are arranged in reverse orientation to join the top panel and side panel of one of the ballast housing members with the bottom panel and side panel of the other ballast housing member. Upon assembly of the pair of ballast housing members, a pair of openings are formed at the opposite ends of the ballast housing. A pair of end panels are provided that mount to the opposite ends of the pair of ballast housing members for covering the openings formed at the opposite ends of the assembled ballast housing. Alternatively, the end panels may be formed integrally with the ballast housing members.

In accordance with another aspect of the present invention, the ballast housing includes a pair of openings on an upper end that are adapted to receive a pair of bent tabs formed on a lower end of the wiring box. In this way, the wiring box pivotally supports the ballast housing between inoperative and operative positions to facilitate mechanical and electrical connection of the ballast housing with the wiring box. The wiring box may be shipped and installed prior to the ballast housing and optical assembly to simplify the installation process. When the ballast housing and optical assembly are fully assembled, they are pivotally supported by the tabs of the wiring box in the inoperative position to permit the necessary electrical connections to be made. Thereafter, the ballast housing and optical assembly may be pivoted upwardly and connected to the wiring box through a captive screw mounted on an upper end of the ballast housing. The wiring box may be connected directly to a horizontal support such as a ceiling. Alternatively, a hook member is provided to mount the luminaire assembly to a hook support, and a connector is provided to mount the luminaire assembly to the threaded end of a pendant support.

In accordance with another aspect of the present invention, the ballast housing includes a pair of support arms that depend from the side panels to releasably support the optical assembly. During assembly of the luminaire assembly, the optical assembly is joined to a lower end of the ballast housing simply by pivoting lower ends of the support arms toward each other to engage mounting flanges provided on a top panel of the reflector or refractor. In this way, the optical assembly may be quickly and easily assembled with the ballast housing at the installation site.

In accordance with yet another aspect of the present invention, the optional lens is biased toward and into engagement with a lower end of the optical assembly through a spring mechanism. A grasping member extends through the lens and has one end connected to the spring mechanism. When the lens is manually pulled away from the lower end of the optical assembly by the grasping member, the lens automatically rotates relative to the optical assembly upon sufficient clearance from the lower end of the optical assembly. In this way, the relamping procedure is greatly simplified.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
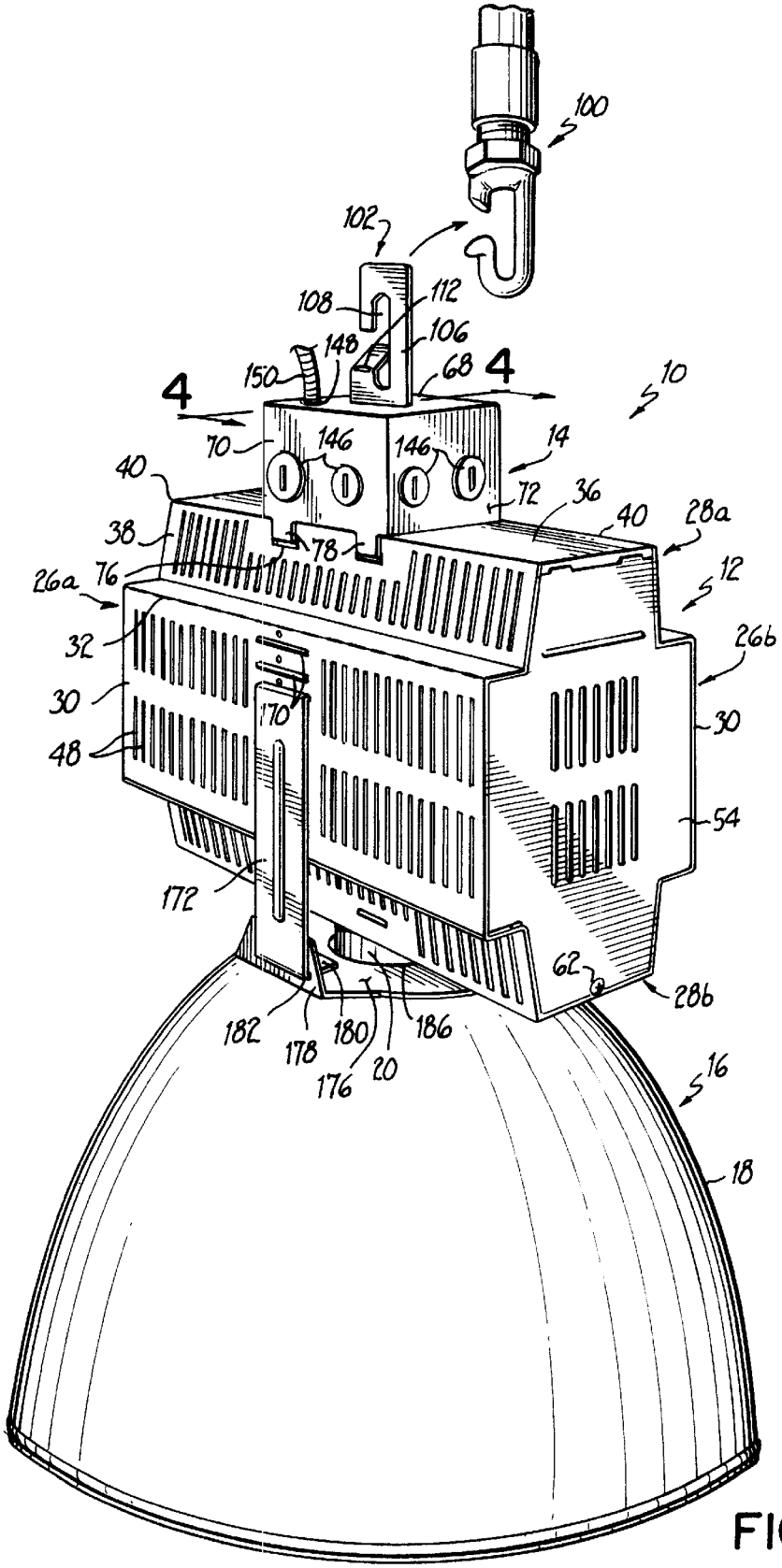
FIG. 1 is a perspective view illustrating a luminaire assembly in accordance with the principles of the present invention, including a ballast housing, a wiring box mounted on an upper end of the ballast housing, and an optical assembly mounted on a lower end of the ballast housing.

With reference to the figures, and to FIG. 1 in particular, a luminaire assembly 10 is shown in accordance with the principles of the present invention for distributing light in an area to be illuminated, such as areas found in indoor industrial, retail and similar lighting environments. Luminaire assembly 10 includes an elongated ballast housing 12 for enclosing a ballast transformer (not shown), capacitor (not shown) and other electrical hardware (not shown) typically associated with luminaires as known by those skilled in the art. A wiring box 14 is mounted on an upper end of the ballast housing 12 for pivotally supporting the ballast housing 12 between operative and inoperative positions as will be described in greater detail below. An optical assembly 16, including a reflector or refractor 18, a lamp socket 20, a light source 22 mounted in lamp socket 20 (FIGS. 8–10 and 12), and an optional lens 24 (FIGS. 8–12), is supported on a lower end of the ballast housing 12. In accordance with the principles of the present invention, luminaire assembly 10 is modular in construction to permit the luminaire housing 12, wiring box 14, and optical assembly 16 to be assembled and installed independently of each other to simplify assembly and installation of the luminaire assembly 10 at a site.

Figure 2:
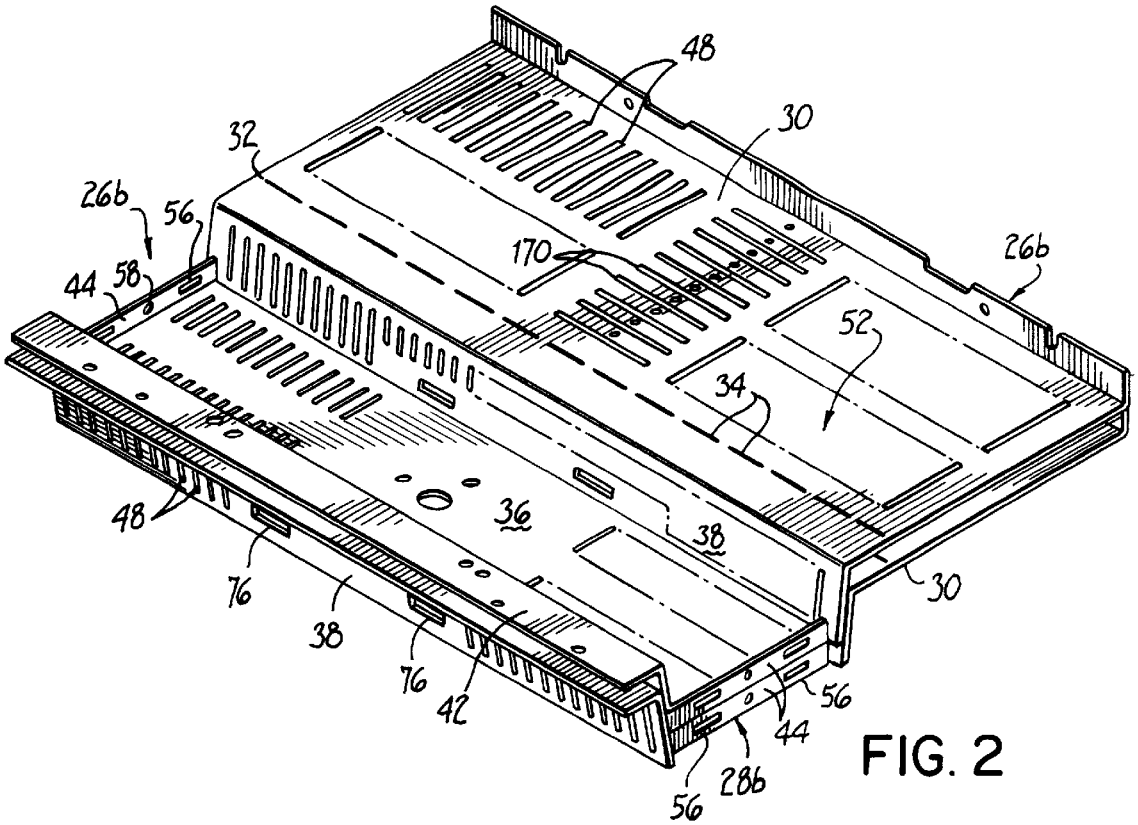
FIG. 2 is a perspective view illustrating a pair of nestable ballast housing members for forming the ballast housing illustrated in FIG. 1.
Figure 3:
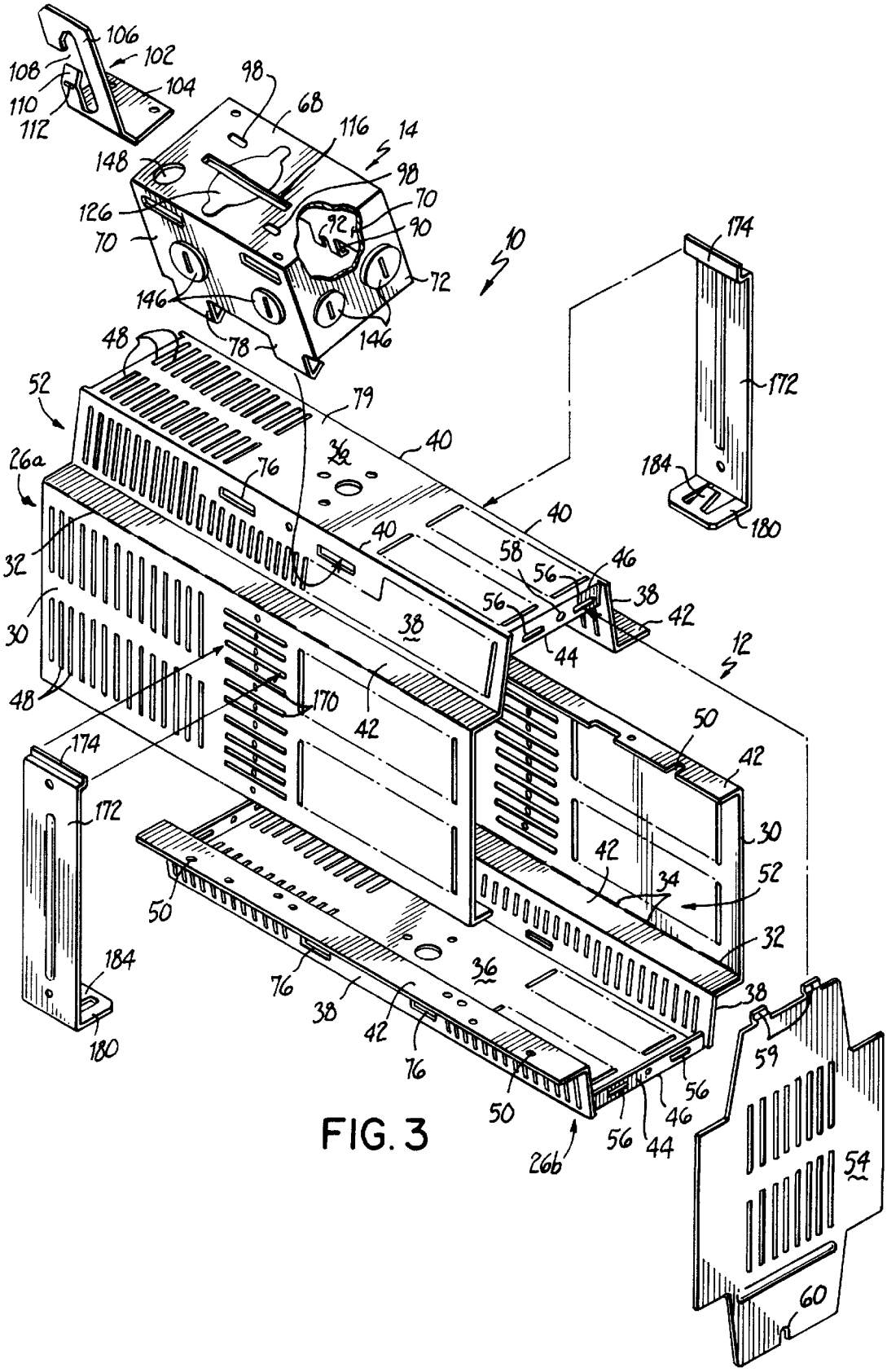
FIG. 3 is an exploded, disassembled view of the luminaire assembly illustrated in FIG. 1.

Referring to FIGS. 1–3, ballast housing 12 includes a pair of integral ballast housing members 26*a*, 26*b* that are each preferably fabricated from a single metal sheet through a die-cutting or other known forming operation. Each of the ballast housing members 26*a*, 26*b* is preferably identical in construction and includes either a top panel 28*a* or bottom panel 28*b* of generally U-shaped cross-section, and an associated side panel 30 integrally joined to the top or bottom panels 28*a*, 28*b* through a fold line 32. Fold lines 32 preferably comprise a plurality of openings 34 (FIG. 2) formed through the thickness of the ballast housing members 26*a*, 26*b*, such as apertures, slits or slots, or may be scored, debossed or otherwise weakened lines, that permit the side panels 30 to be folded by hand generally perpendicular to the top and bottom panels 28*a*, 28*b*, as shown most clearly in FIGS. 1 and 3.

As best understood with reference to FIG. 2, each of the ballast housing members 26*a*, 26*b* is preferably initially fabricated in an easily stackable or nestable configuration to permit compact storage of the ballast housing members 26*a*, 26*b* and to simplify shipping of the parts prior to final assembly of the ballast housing 12 as described in detail below. It will be appreciated that reference herein to a "top" panel or a "bottom" panel in connection with ballast housing panels 26*a*, 26*b* is used merely to simplify description of the ballast housing 12, as the top and bottom panels 28*a*, 28*b* are structurally identical in a preferred embodiment of the present invention.

Further referring to FIGS. 1–3, each of the top and bottom panels 28*a*, 28*b* of ballast housing members 26*a*, 26*b* preferably includes a substantially planar wall 36, and a pair of spaced side walls 38 extending away from the planar wall 36 along opposite side margins 40. A flange wall 42 extends outwardly from each side wall 38, and a pair of spaced end walls 44 extend away from the planar wall 36 along opposite end margins 46. After initial fabrication, i.e., before any folding operation by hand, the side panels 30 of the ballast housing members 26*a*, 26*b* preferably lie in a plane that is substantially parallel to the planar walls 36 of the top and bottom panels 28*a*, 28*b*, as best understood with reference to FIG. 2, to provide the advantageous stacking or nesting configuration of the ballast housing members 26*a*, 26*b* as described above. Of course, other configurations of the top and bottom panels 28*a*, 28*b* and side panels 30 are possible without departing from the spirit and scope of the present invention. A plurality of elongated slots 48 are formed through the thickness of the ballast housing members 26*a*, 26*b* to provide convection air cooling for the electrical hardware (not shown) mounted within ballast housing 12 during use of the luminaire assembly 10 as will be appreciated by those skilled in the art.

Referring to FIG. 3, assembly of ballast housing 12 will now be described. As described above, the ballast housing members 26*a*, 26*b* are initially fabricated to have the stackable or nestable configuration of FIG. 2. When assembly of the ballast housing 12 is required either at the factory or at an installation site, the side panels 30 of ballast housing member 26*a*, 26*b* are folded by hand along fold lines 32 to lie substantially perpendicular to the top and bottom panels 28*a*, 28*b*. The pair of ballast housing members 26*a*, 26*b* are arranged in reverse orientation as shown in FIG. 3 to permit the side panel 30 of ballast housing member 26*b* to be joined with the top panel 28*a* of ballast housing member 26*a*, and the side panel 30 of the other ballast housing member 26*a* to be joined with the bottom panel 28*b* of ballast housing member 26*b*. Suitable fasteners (not shown) are provided that extend through aligned apertures 50 formed in the abutting flange walls 42 of the ballast housing members 26*a*, 26*b* to join the ballast housing members 26*a*, 26*b* in the form of ballast housing 12.

Upon assembly of the ballast housing members 26*a*, 26*b* as described above, a pair of openings, indicated generally at 52 (FIG. 3), are formed at the opposite ends of the ballast housing 12. A pair of ends panels 54 are provided that mount to the opposite ends of the ballast housing members 26*a*, 26*b* for covering the openings 52 formed at the opposite ends of the assembled ballast housing 12.

In accordance with one embodiment of the present invention, as best understood with reference to FIG. 3, each of the end walls 44 includes a pair of elongated openings 56 and a central aperture 58 formed through the thickness of the end walls 44. Each end panel 54 includes a pair of offset tabs 59 formed at one end that register with and are received in a respective pair of the elongated openings 56 formed in the ends walls 44. The offset tabs 59 and elongated openings 56 permit the ends panels 54 to generally pivot to a closed position over the openings 52 formed at the opposite ends of the assembled ballast housing 12 as shown in FIG. 1. The other end of each end panel 54 preferably includes a notch 60 (FIG. 3) for receiving a suitable fastener 62 (FIG. 1) that extends through the notch 60 and a respective central aperture 58 formed in the end walls 44. The fasteners 62, in combination with the cooperation of the offset tabs 59 and elongated openings 56 at the opposite end of each end panel 54, retain the ends panels 54 in the closed position as shown in FIG. 1.

Figure 2A:
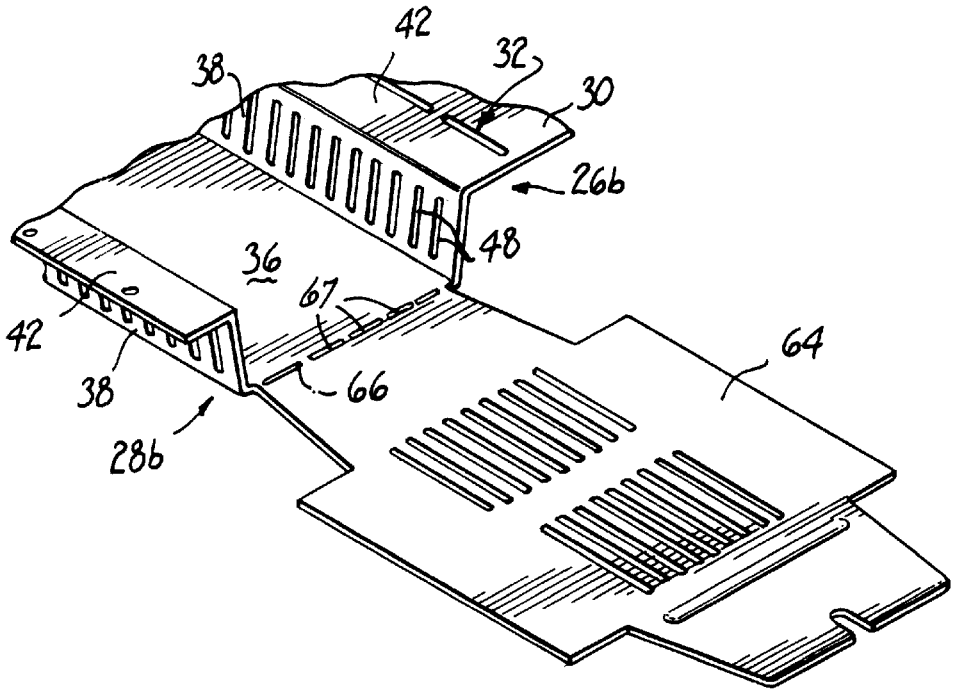
FIG. 2A is a partial perspective view of an alternative ballast housing member including an integral end panel.

In accordance with an alternative embodiment of the present invention as shown in FIG. 2A, end panels 64 may be formed integrally with the ballast housing members 26*a*, 26*b*. Fold lines 66 are formed through the thickness of the ballast housing members 26*a*, 26*b* to permit the integral end panels 64 to be folded by hand generally perpendicular to the top and bottom panels 28*a*, 28*b* for closing the openings formed at the opposite ends of the assembled ballast housing 12. Fold lines 66 preferably comprise a plurality of openings 67 formed through the thickness of the ballast housing members 26*a*, 26*b*, such as apertures, slits or slots, or may be scored, debossed or otherwise weakened lines, that permit the end panels 64 to be folded by hand. The integral end panels 64 may also be fastened at one end through suitable fasteners (not shown) to the ballast housing members 26*a*, 26*b* as described in detail above and shown in FIG. 1.

Figure 4:
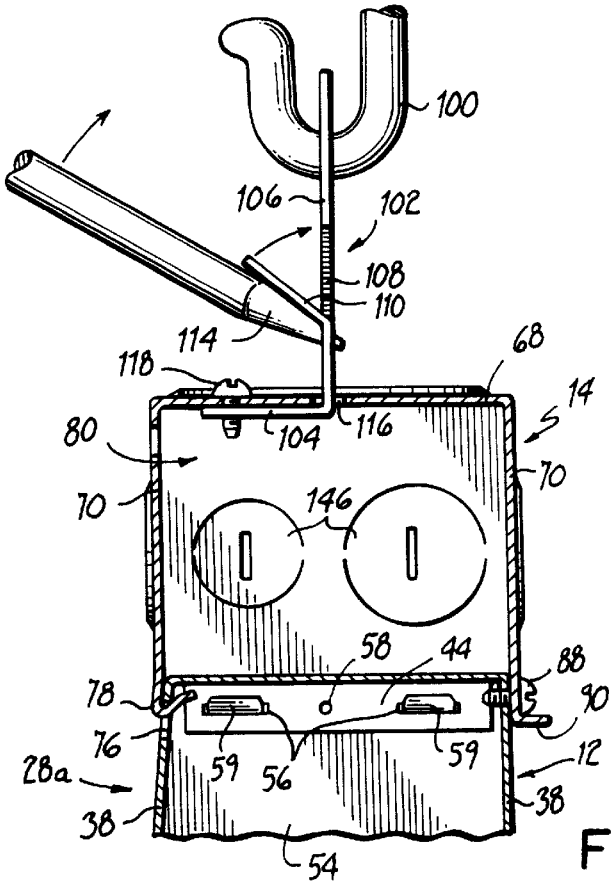
FIG. 4 is a partial cross-sectional view taken along line 4—4 of FIG. 1, illustrating a hook member connected to the wiring box for supporting the luminaire assembly from a support member.
Figure 5:
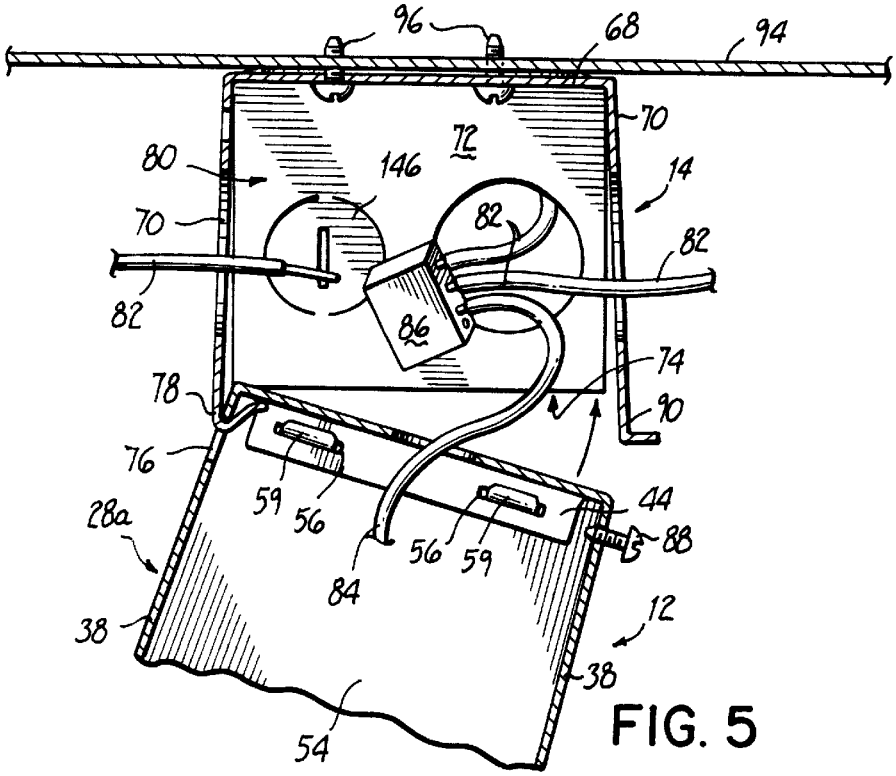
FIG. 5 is a view similar to FIG. 4, illustrating direct mounting of the wiring box to a horizontal support and a pivotal connection between the wiring box and the ballast housing.

Referring now to FIGS. 1, 3–5 and 5A, wiring box 14 is preferably formed of a single metal sheet and includes a top panel 68, a pair of side panels 70 and a pair of end panels 72 that form an opening 74 (FIG. 5) at a lower end of the wiring box 14. In accordance with one aspect of the present invention, ballast housing 12 includes a pair of openings 76 formed on an upper end that are adapted to receive a pair of bent tabs 78 formed on a lower end of the wiring box 14 as indicated by arrow 79 in FIG. 3. The pair of tabs 78 of wiring box 14 cooperate with the pair of openings 76 of ballast housing 12 to pivotally support the ballast housing 12 between an inoperative position as shown in FIG. 5 wherein an internal wiring chamber 80 of the wiring box 14 is exposed, and an operative position as shown in FIGS. 1 and 4 wherein the opening 74 at the lower end of the wiring box 14 is closed by the upper end of the ballast housing 12.

In the inoperative position, internal wiring 82 within wiring box 14 may be electrically connected to wiring 84 connected with the electrical hardware (not shown) of the luminaire assembly 10 through electrical connector blocks 86 (FIG. 5) or other connector hardware (not shown) known by those skilled in the art. In this way, the wiring box 14 of luminaire assembly 10 may be shipped and installed prior to the ballast housing 12 and optical assembly 16. When the ballast housing 12 and optical assembly 16 are fully assembled as described in detail below, they are simply pivotally supported by the tabs 78 of the wiring box 14 in the inoperative position as described in detail above to permit the necessary electrical connections to be made within the wiring box 14.

To facilitate mounting of the ballast housing 12 to the wiring box 14 in the operative position as shown in FIGS. 1 and 4, the upper end of ballast housing 12 preferably includes a captive (i.e., self-threading) screw 88 (FIGS. 4 and 5) that cooperates with a flange member 90 formed on a lower end of the wiring box 14. The flange member 90 of wiring box 14 is adapted to engage the captive screw 88 when it is fully fastened to support the ballast housing 12 in the operative position. The flange member 90 preferably includes an elongated notch 92 (FIG. 3) that is adapted to slidably receive a shank of the screw 88 before it is fully fastened to retain the ballast housing 12 in the operative position.

During installation of the luminaire assembly 10, the wiring box 14 may be initially separately mounted directly to a horizontal support 94, such as a ceiling, through fasteners 96 that extend upwardly through a pair of apertures 98 formed in the top panel 68 of the wiring box 14 as shown in FIG. 5. Alternatively, the wiring box 14 may be suspended from a hook support 100 through an associated hook member 102 as shown in FIGS. 1, 3 and 4.

In accordance with this aspect of the present invention, the hook member 102 includes a lower end adapted to support wiring box 14, and an upper end adapted to be supported by the hook support 100. More particularly, as shown most clearly in FIGS. 3 and 4, hook member 102 includes a support flange 104 formed on its lower end, and a hook-forming flange 106 formed on its upper end that extends generally transverse to the support flange 104. The hook-forming flange 106 includes an elongated opening 108 for receiving the hook support 100 through the opening 108, and a bendable tab 110 that at least partially closes the opening 108 in a closed position of the bendable tab 110. A tool-receiving slot 112 is formed adjacent the bendable tab 110 for receiving a tool, such as a tip of screwdriver 114 (FIG. 4), to bend the tab 110 to the closed position.

The wiring box 14 includes an elongated slot 116 formed in the top panel 68 for receiving the support flange 104 within the wiring box 14. The support flange 104 extends generally parallel to and supports the top panel 68 of the wiring box 14, and the hook-forming flange 106 extends through the elongated slot 116 of the wiring box 14 generally transverse to the top panel 68. A fastener 118 (FIG. 4) may be provided to secure the support flange 104 to the top panel 68 of the wiring box 14.

Figure 6:
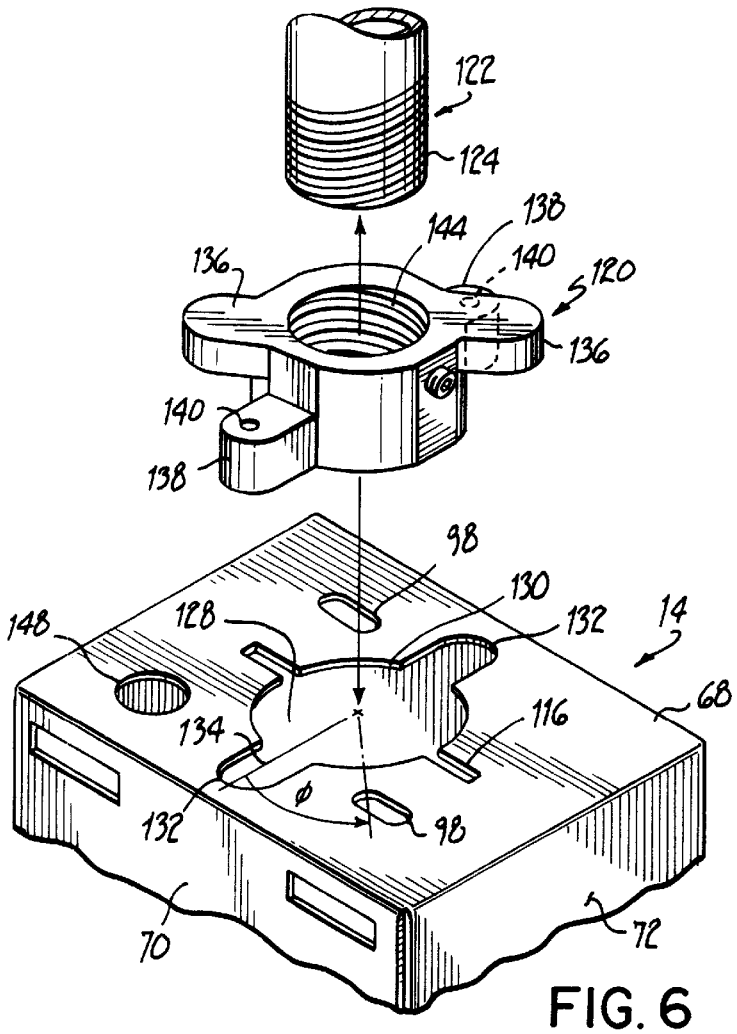
FIG. 6 is a partial exploded perspective view illustrating a connector member for mounting the luminaire assembly to a support member.
Figure 7:
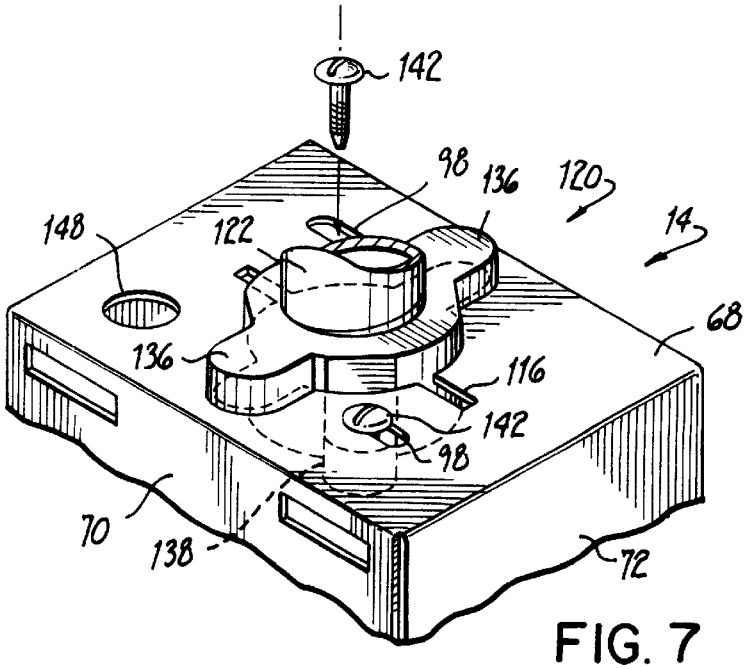
FIG. 7 is a view similar to FIG. 6 illustrating attachment of the connector member to an upper end of the wiring box.

In accordance with another aspect of the present invention, a connector 120 (FIGS. 6 and 7) is provided to mount the wiring box 14 to a pendant support 122 that terminates in a threaded end 124. The top panel 68 of wiring box 14 includes a knockout 126 (FIG. 3) that forms a keyhole opening 128 in the top panel 68 when the knockout 126 is manually removed. The keyhole opening 128 preferably includes a circular opening 130 and a pair of opposite notches 132 extending radially outwardly from the circular opening 130. The pair of apertures 98 described above that are formed in the top panel 68 of wiring box 14 are preferably angularly offset by an angle "ϕ" (FIG. 6) from a longitudinal axis 134 of the keyhole opening 128. Preferably, the pair of apertures 98 are angularly offset by an angle of 45° relative to the longitudinal axis 134 of the keyhole opening 128.

The connector 120 includes a pair of upper tabs 136 that extend radially outwardly from the connector 120, and are preferably diametrically opposed. A lower pair of tabs 138 also extend radially outwardly from the connector 120 and are spaced axially from the upper pair of tabs 136. Preferably, the lower pair of tabs 138 are diametrically opposed, and are angularly offset from the upper pair of tabs 136 by an angle of 45°. The lower pair of tabs 138 include threaded bores 140 for receiving fasteners 142 (FIG. 7) as described in detail below.

The connector 120 preferably includes a partially threaded bore 144 that is adapted to thread to the threaded end 124 of the pendant support 122. The connector 120 is inserted through the keyhole opening 128 formed in the top panel 68 of the wiring box 14, with the lower pair of tabs 138 in registry with and extending through the pair of notches 132. Upon rotation of the connector 120 relative to the wiring box 14, the threaded bores 140 of the lower pair of tabs 138 register with the pair of angularly offset apertures 98 formed in the top panel 68 of the wiring box 14 for receiving the fasteners 142. Rotation of the connector 120 relative to the wiring box 14 also permits the upper pair of tabs 136 to cover the notches 132 formed in the top panel 68 of the wiring box 14.

Wiring box 14 includes a pair of knockouts 146 on each of the side panels 70 and end panels 72 to permit through-wiring of the luminaire assembly 10 as will be appreciated by those skilled in the art. An opening 148 (FIGS. 1 and 3) is formed on the top panel 68 to permit an electrical cord and plug or conductor 150 (FIG. 1) to extend from the wiring box 14 to electrically connect with an electrical power outlet (not shown).

In accordance with another aspect of the present invention, an optional spacer box 152 (FIG. 5A) is provided to mount ballast housing 12 in spaced relationship from the wiring box 14, as may be required to provide a heat barrier to maintain 90° C. rated supply-wire 82 (FIG. 5) within the wiring box 14. More particularly, spacer box 152 is preferably formed identically to wiring box 14 from a single metal sheet, and includes a top panel 154, a pair of side panels 156 and a pair of end panels 158 that form an opening 160 at a lower end of the spacer box 152.

Figure 5A:
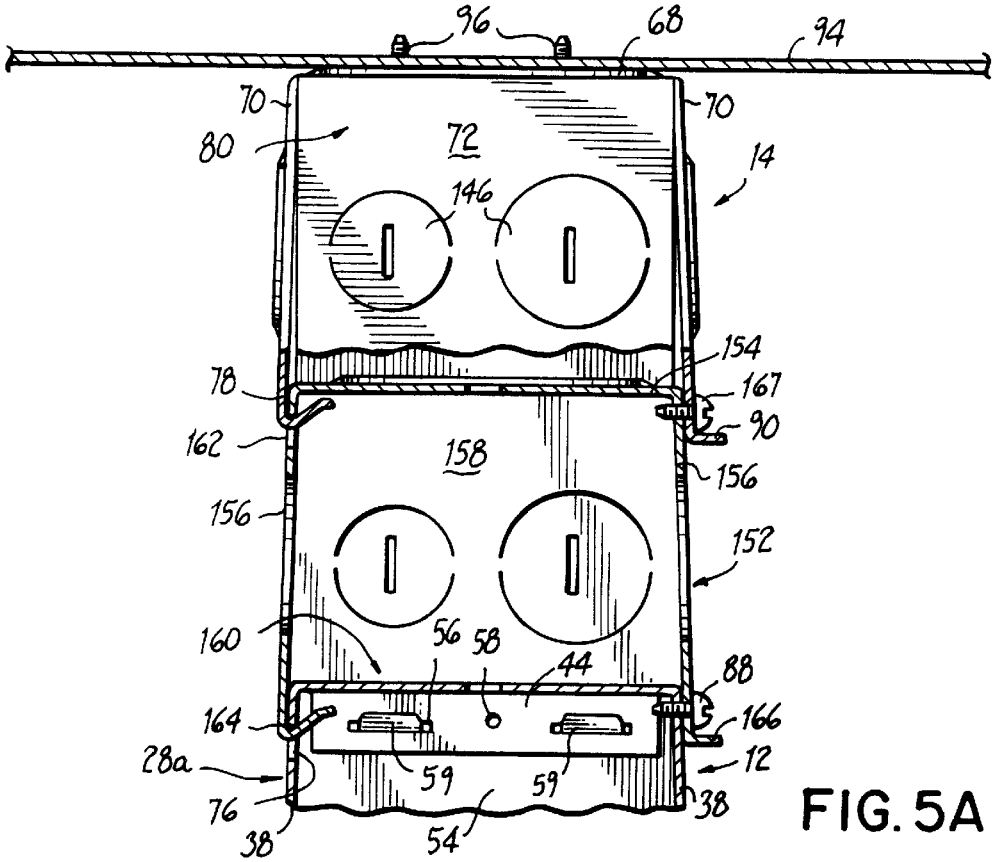
FIG. 5A is a view similar to FIG. 5, illustrating a spacer box mounted on an upper end of a wiring box for supporting the luminaire assembly illustrated in FIG. 1.

As best understood with reference to FIG. 5A, spacer box 152 includes a pair of openings 162 formed on its upper end that are adapted to receive the pair of bent tabs 78 formed on a lower end of the wiring box 14. Spacer box 152 includes a pair of bent tabs 164 formed on a lower end that are adapted to cooperate with the pair of openings 76 formed on the upper end of ballast housing 12 to support the ballast housing 12 in the operative position as shown in FIG. 5A. Spacer box 152 includes a flange member 166 that engages captive fastener 88 connected to ballast housing 12 when it is fully tightened. A fastener 167 is provided to engage the flange member 90 of wiring box 14 with an upper end of spacer box 152 as shown in FIG. 5A. It will be appreciated that depending on the wattage of luminaire assembly 10, one or more spacer boxes 152 may be required to maintain the 90° C. rated supply-wire 82 (FIG. 5) within the wiring box 14.

Referring now to FIGS. 1 and 3, mounting of optical assembly 16 to the ballast housing 12 will now be described. As best understood with reference to FIG. 3, the side panels 30 of the ballast housing members 26*a*, 26*b* preferably include a plurality of vertically spaced openings 170 formed through the thickness of the side panels 30. A pair of support arms 172 are provided that are releasably engageable at their respective upper ends with the plurality of openings 170. Preferably, the support arms 172 include offset flanges 174 formed on the respective upper ends that are pivotally received in the openings 170 of the ballast housing members 26*a*, 26*b*. The reflector or refractor 18 of optical assembly 16 includes a top panel 176 and a pair of spaced mounting flanges 178 that extend upwardly from the top panel 176 and are adapted to releasably engage with lower ends of the support arms 172 to support the optical assembly 16 below the ballast housing 12 as shown in FIG. 1. Preferably, the lower ends of the support arms 172 terminate in support flanges 180 that extend generally transverse to the support arms 172 and are received in openings 182 formed in the mounting flanges 178 of the optical assembly 16. The support flanges 180 preferably include protuberances 184 (FIG. 3) that releasably engage with the openings 182 in the mounting flanges 178 to support the optical assembly 16 below the ballast housing 12.

During assembly of the luminaire assembly 10, the lamp socket 20 is mounted to the lower end of the ballast housing 12 through suitable fasteners (not shown). The top panel 176 of optical assembly 16 includes an opening 186 (FIG. 1) suitably sized for receiving the lamp socket 20 within an interior of the reflector or refractor 18. With the lamp socket 20 positioned within the interior of the reflector or refractor 18, the optical assembly 16 is secured to the lower end of ballast housing 12 simply by pivoting the lower ends of the support arms 172 toward each other so that the protuberances 184 on support flanges 180 engage the openings 182 formed on the mounting flanges 178. In this way, the optical assembly 16 may be quickly and easily assembled with the ballast housing 12 at the installation site without fasteners. Of course, suitable fasteners (not shown) may be provided to securely fasten the support arms 172 to the side panels 30 of the ballast housing members 26*a*, 26*b* after the lower ends of the support arms 172 have been engaged with the mounting flanges 178 of the optical assembly 16.

As best understood with reference to FIGS. 8–12, mounting of the optional lens 24 to the optical assembly 16 will now be described. In accordance with one aspect of the present invention as shown in FIGS. 8–10, the lens 24 is biased toward and into engagement with a lower end of the optical assembly 16 through a spring mechanism 188 connected to the top panel 176 of optical assembly 16.

Figure 12:
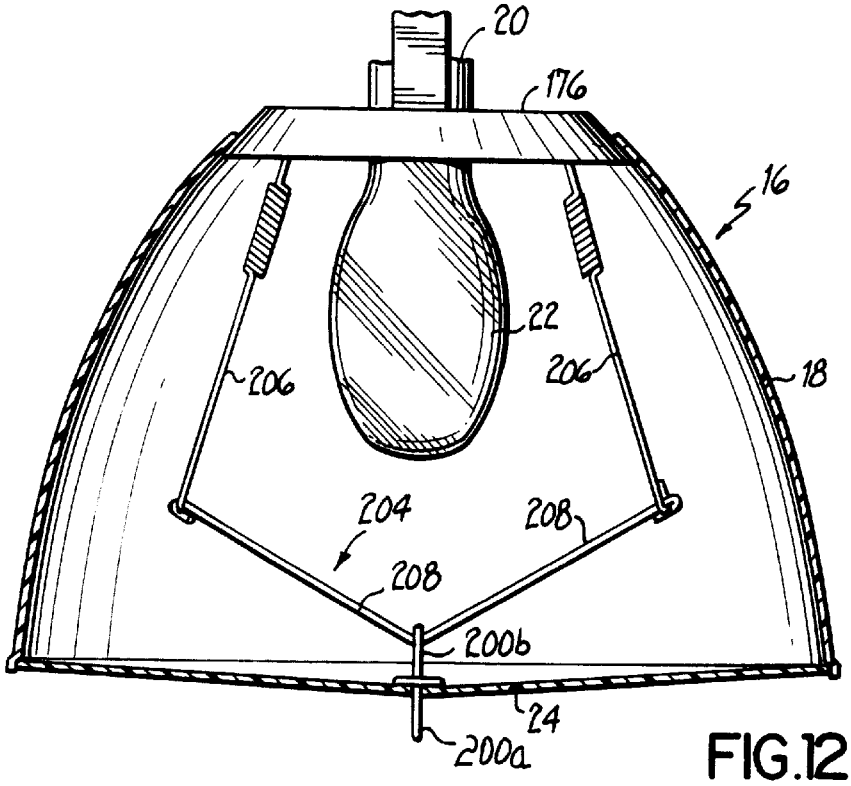
FIG. 12 is a view similar to FIG. 11, illustrating a second alternative embodiment for mounting the lens to the lower end of the optical assembly.

More particularly, the spring mechanism 188 preferably includes a pair of rigid arms 190 that are fastened to the top panel 176 of the optical assembly 16. A resilient spring 192 includes a pair of arms 194 that are connected at respective ends to the pair of rigid arms 190. The spring 192 includes a central coil 196 that provides the resiliency in the arms 194 as will be appreciated by those skilled in the art. A grasping member 198 extends through the lens 24 and includes a pair of loop portions 200*a* generally aligned with the vertical axis 202 of the optical assembly 16, and a loop portion 200*b* connected to the spring mechanism 188 at a position offset from the vertical axis 202 of the optical assembly 16. Alternatively, as shown in FIG. 12, spring mechanism 204 includes a pair of tension springs 206 that are connected at their respective upper ends to the top panel 176 of optical assembly 16, and a generally rigid arm 208 centrally connected to the offset loop portion 200*b* of grasping member 198. The opposite ends of the rigid arm 208 are attached to respective lower ends of the tension springs 206.

Figure 8:
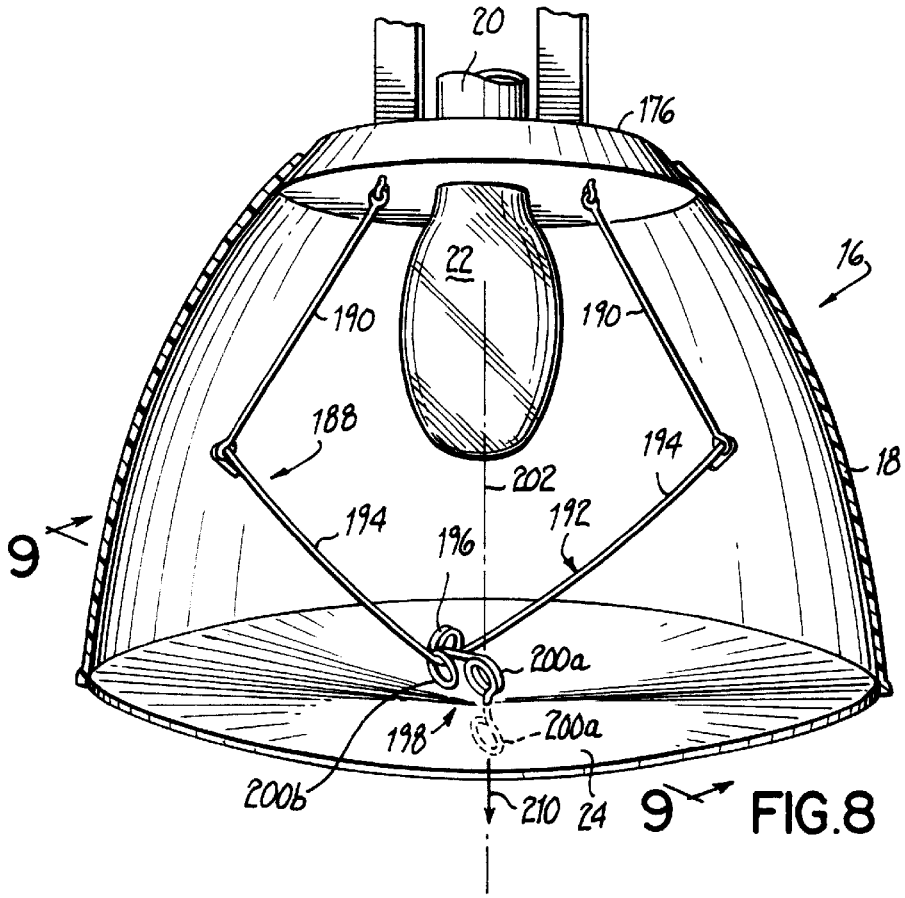
FIG. 8 is a partial plan view illustrating one embodiment for mounting a lens to a lower end of the optical assembly.
Figure 9:
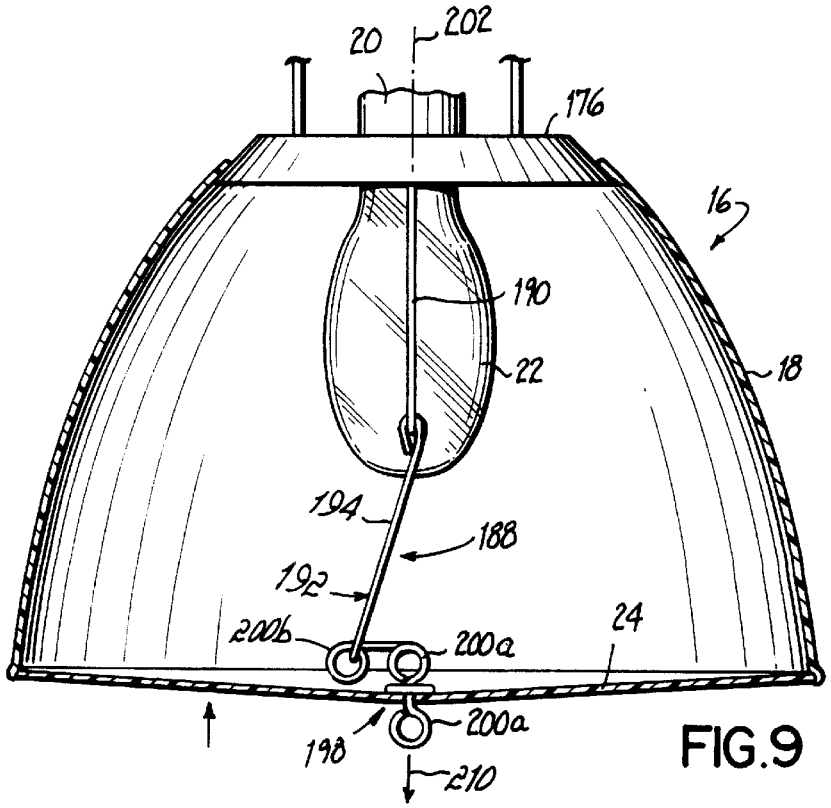
FIG. 9 is a cross-section view taken along line 9—9 of FIG. 8.
Figure 10:
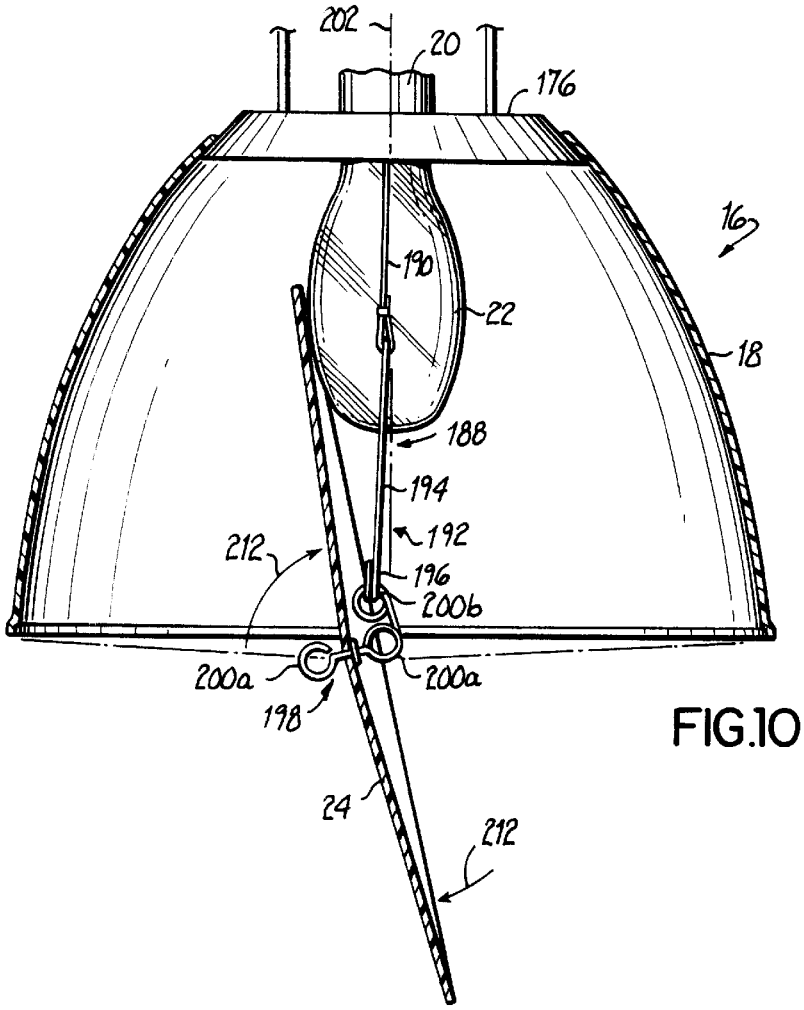
FIG. 10 is a view similar to FIG. 9, illustrating pivoting of the lens relative to the optical assembly.

During a relamping procedure, lens 24 is operable to be manually pulled away from the lower end of the optical assembly 16 by manual pulling the lower loop portion 200*a* in a direction generally parallel to the vertical axis 202 of optical assembly 16, as indicated by arrow 210 in FIGS. 8 and 9. Upon sufficient clearance from the lower end of the optical assembly 16, lens 24 is operable to simultaneously pivot relative to the optical assembly 16, as indicated by arrows 212 in FIG. 10. In this way, the off-center connection of the spring mechanisms 188, 204 to the loop portion 200*b* of the grasping member 198 causes the lens 24 to automatically pivot in the direction of arrows 212 upon a manual pulling action on the grasping member 198 in the direction of arrow 210 to simplify the relamping procedure.

Figure 11:
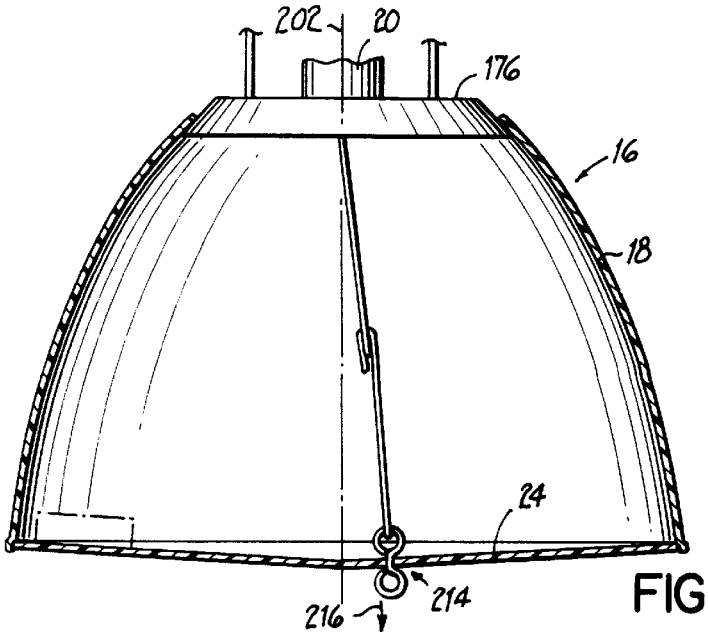
FIG. 11 is a view similar to FIG. 8, illustrating an alternative embodiment for mounting the lens to the lower end of the optical assembly.

Alternatively, as shown in FIG. 11, a grasping member 214 may extend through the lens 24 at a position offset from the longitudinal axis 202 of the optical assembly 16. Upon manual pulling of the grasping member 214 in a direction parallel to the longitudinal axis 202 of the optical assembly 16, as indicated by arrow 216, the off-center connection of the grasping member 214 with the lens 24 will cause the lens 24 to automatically pivot relative to the optical assembly 16 as described in detail above with reference to FIG. 10.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of applicants' general inventive concept.

Having described the invention, what is claimed is:

1. A luminaire assembly, comprising:

an integral first housing member including a top panel and a side panel;

an integral second housing member including a bottom panel and a side panel, wherein said first and second housing members are operatively connected to form a ballast housing having a pair of spaced apart openings at opposite ends thereof;

a pair of end panels operatively connected to said first and second housing members for covering the spaced apart openings formed at the opposite ends of said ballast housing; and an optical assembly supported below said ballast housing being adapted to receive a light source and further being operable to distribute light emanating therefrom in an area to be illuminated.

2. The luminaire assembly of claim 1 wherein each of said end panels is integral with one of said first and second housing members.

3. The luminaire assembly of claim 1 wherein said each of said first and second housing members is fabricated of a single metal sheet.

4. The luminaire assembly of claim 1 wherein said first and second housing members are fabricated substantially identical in configuration.

5. The luminaire assembly of claim 1 wherein said top panel is joined to said side panel through a fold line whereby said top panel and side panel are foldable relative to each other by hand.

6. The luminaire assembly of claim 5 wherein said bottom panel is joined to said side panel through a fold line whereby said bottom panel and side panel are foldable relative to each other by hand.

7. The luminaire assembly of claim 6 wherein each of said fold lines includes a plurality of openings formed through the thickness of said first and second housing members.

8. The luminaire assembly of claim 1 wherein each of said top and bottom panels includes a substantially planar wall and a pair of spaced side walls extending away from said planar wall along opposite side margins thereof.

9. The luminaire assembly of claim 8 wherein each of said top and bottom panels includes a pair of flange walls, wherein each flange wall extends outwardly from one of said side walls.

10. The luminaire assembly of claim 8 wherein each of said top and bottom panels includes a pair of spaced end walls extending away from said planar wall along opposite end margins thereof.

11. The luminaire assembly of claim 10 wherein each pair of spaced end walls includes at least one opening formed through the thickness thereof.

12. The luminaire assembly of claim 11 wherein each of said end panels includes at least one tab member adapted to be received in said openings formed in said end walls.

13. The luminaire assembly of claim 12 further including at least one fastener extending through each end panel and into one of said pair of end walls.

14. The luminaire assembly of claim 8 wherein each of said side panels is adapted to lie in a plane substantially parallel to said substantially planar wall of said top and bottom panels prior to assembly of said ballast housing.

15. The luminaire assembly of claim 14 wherein said first and second housing members are nestable prior to assembly of said ballast housing.

16. A luminaire assembly, comprising:

a ballast housing including a top panel, a bottom panel, and a pair of opposite sides panels, each of said side panels including a plurality of spaced openings formed therein;

a pair of elongated support arms depending from said ballast housing, each of said support arms having an offset flange formed an upper end thereof for insertion in one of said openings formed in said side panels and a lower end terminating in a support flange; and an optical assembly including a pair of upstanding mounting flanges adapted to releasably engage with said support flanges, whereby said optical assembly is supported below said ballast housing upon engagement of said support flanges with said mounting flanges.

17. The luminaire assembly of claim 16 wherein said optical assembly includes one of a reflector and a refractor, a light socket extending into said one of a reflector and a refractor, and a light source mounted in said light socket.

18. The luminaire assembly of claim 17 further including a lens mounted on a lower end of said one of a reflector and a refractor.

19. The luminaire assembly of claim 16 wherein said support flange formed at the lower end of each support arm extends generally transverse to said support arm.

20. The luminaire assembly of claim 19 wherein each upstanding mounting flange of said optical assembly includes an opening formed therethrough adapted to receive said support flange of said support arms.

21. The luminaire assembly of claim 20 wherein each of said support flanges includes a protuberance adapted to releasably engage with said openings formed in said mounting flanges.

22. A method of making a luminaire assembly, comprising:

providing a first housing member including an integral top panel and a side panel;

providing a second housing member including an integral bottom panel and a side panel;

operatively connecting the first and second housing members to form a ballast housing having a pair of spaced apart openings at opposite ends thereof, with the side panel of the first housing member operatively connected to bottom panel of the second housing member, and with the side panel of the second housing member operatively connected to the top panel of the first housing member;

providing a pair of end panels;

operatively connecting the pair of end panels to the first and second housing panels for covering the spaced apart openings formed at the opposite ends of the ballast housing; and supporting an optical assembly from the ballast housing, the optical assembly being adapted to receive a light source for distributing light emanating therefrom in a desired pattern on a surface to be illuminated.

23. The method of claim 22 further including the step of die cutting each of the first and second housing members from a single metal sheet.

24. The method of claim 23 wherein said die cutting step includes die cutting the first and second housing members to be shaped substantially identical.

25. The method of claim 22 wherein the top panel is joined to the side panel through a fold line whereby the top panel and side panel are foldable relative to each other by hand.

26. The method of claim 22 wherein the bottom panel is joined to the side panel through a fold line whereby the bottom panel and side panel are foldable relative to each other by hand.

27. The method of claim 22 further including the step of nesting the first and second housing members prior to assembly of the ballast housing.

28. The method of claim 22 further including the step of suspending the optical assembly from the ballast housing through a pair of support arms that releasably engage each of the side panels and an upper end of the optical assembly.

29. The method of claim 22 further including the step of mounting a lens to a lower end of the optical assembly.

30. The method of claim 22 further including the step of pivotally mounting a first wiring box to the top panel.

31. The method of claim 30 further including the step of mounting a second wiring box to an upper end of the first wiring box.

32. The method of claim 30 further including the step of mounting a hook member to an upper end of the first wiring box.

33. The method of claim 32 further including the step of providing an elongated slot in the hook member for receiving a support member therethrough and a bendable tab operable to substantially close peripheral edges of the elongated slot in a closed position of the bendable tab.

* * * * *

UNITED STATES PATENT AND TRADEMARK OFFICE

CERTIFICATE OF CORRECTION

PATENT NO. : 6,561,676 B1
DATED : May 13, 2003
INVENTOR(S) : Fischer et al.

It is certified that error appears in the above-identified patent and that said Letters Patent is hereby corrected as shown below:

Title page,
Item [63], Related U.S. Application Data, "Continuation of application" should read -- Divisional of application --.

Column 1,
Line 3, "is a continuation of" should read -- is a divisional of --.

Column 5,
Lines 16-17, "housing member" should read -- housing members --.
Line 33, "ends panels" should read -- end panels --.
Line 44, "ends walls" should read -- end walls --.
Lines 45 and 54, "ends panels" should read -- end panels --.

Column 9,
Line 29, "manual pulling" should read -- manually pulling --.

Column 10,
Line 67, "formed an" should read -- formed on an --.

Signed and Sealed this

Sixth Day of January, 2004

JAMES E. ROGAN
*Director of the United States Patent and Trademark Office*